US010549291B2

(12) United States Patent
Ballu et al.

(10) Patent No.: US 10,549,291 B2
(45) Date of Patent: Feb. 4, 2020

(54) SPRAY NOZZLE FOR ELECTROSTATIC SPRAYING OF A COATING PRODUCT AND FACILITY FOR SPRAYING A COATING PRODUCT INCLUDING SUCH A SPRAY NOZZLE

(71) Applicant: Sames Technologies, Melyan (FR)

(72) Inventors: Patrick Ballu, Reims (FR); Michel Di-Gioia, Seyssinet Pariset (FR); Gilles Goisot, Saint Ismier (FR); Philippe Provenaz, Meylan (FR)

(73) Assignee: SAMES KREMLIN, Meylan (FR)

( * ) Notice: Subject to any disclaimer, the term of this patent is extended or adjusted under 35 U.S.C. 154(b) by 676 days.

(21) Appl. No.: 14/901,896

(22) PCT Filed: Jul. 8, 2014

(86) PCT No.: PCT/EP2014/064554
§ 371 (c)(1),
(2) Date: Dec. 29, 2015

(87) PCT Pub. No.: WO2015/004111
PCT Pub. Date: Jan. 15, 2015

(65) Prior Publication Data

US 2016/0368007 A1 Dec. 22, 2016

(30) Foreign Application Priority Data

Jul. 9, 2013 (FR) ..... 13 56727

(51) Int. Cl.
*B05B 5/00* (2006.01)
*B05B 5/053* (2006.01)
(Continued)

(52) U.S. Cl.
CPC ..... *B05B 5/0533* (2013.01); *B05B 1/3046* (2013.01); *B05B 1/32* (2013.01)

(58) Field of Classification Search
CPC ..... B05B 5/0533; B05B 1/3046; B05B 1/32; B05B 5/006; B05B 5/025; B05B 5/03; B05B 5/053; B05B 5/0531; B05B 12/002
(Continued)

(56) References Cited

U.S. PATENT DOCUMENTS 3,056,557 A * 10/1962 Walberg ..... B05B 5/03 118/629
3,583,632 A * 6/1971 Shaffer ..... B05B 5/03 239/583
(Continued)

FOREIGN PATENT DOCUMENTS

DE 4106564 A1 9/1992
JP H05-087017 A 4/1993
(Continued)

OTHER PUBLICATIONS

International Search report for PCT/EP2014/064554 dated Aug. 27, 2014.
Sear Report for FR 1356727 dated Feb. 21, 2014.

*Primary Examiner* — Viet Le
(74) *Attorney, Agent, or Firm* — Pearne & Gordon LLP

(57) ABSTRACT

A spray nozzle for electrostatic spraying of a coating product including a needle forming a mobile shutter of a valve for controlling the spraying, which is positioned in a recess of a barrel of the nozzle. The recess defines a surface for guiding the axial translation of the needle along a longitudinal axis of the recess. The needle includes a front shaped for abutting a seat to obstruct a duct for flow of the coating product, a rear portion which interacts with means for controlling the translation of the needle and a central portion comprised between the front end and the rear portion, while a high-voltage unit included in the nozzle is capable of applying a high-voltage to the front end of the needle. A raised portion provided on the central portion of the needle,
(Continued)

Figure 1:
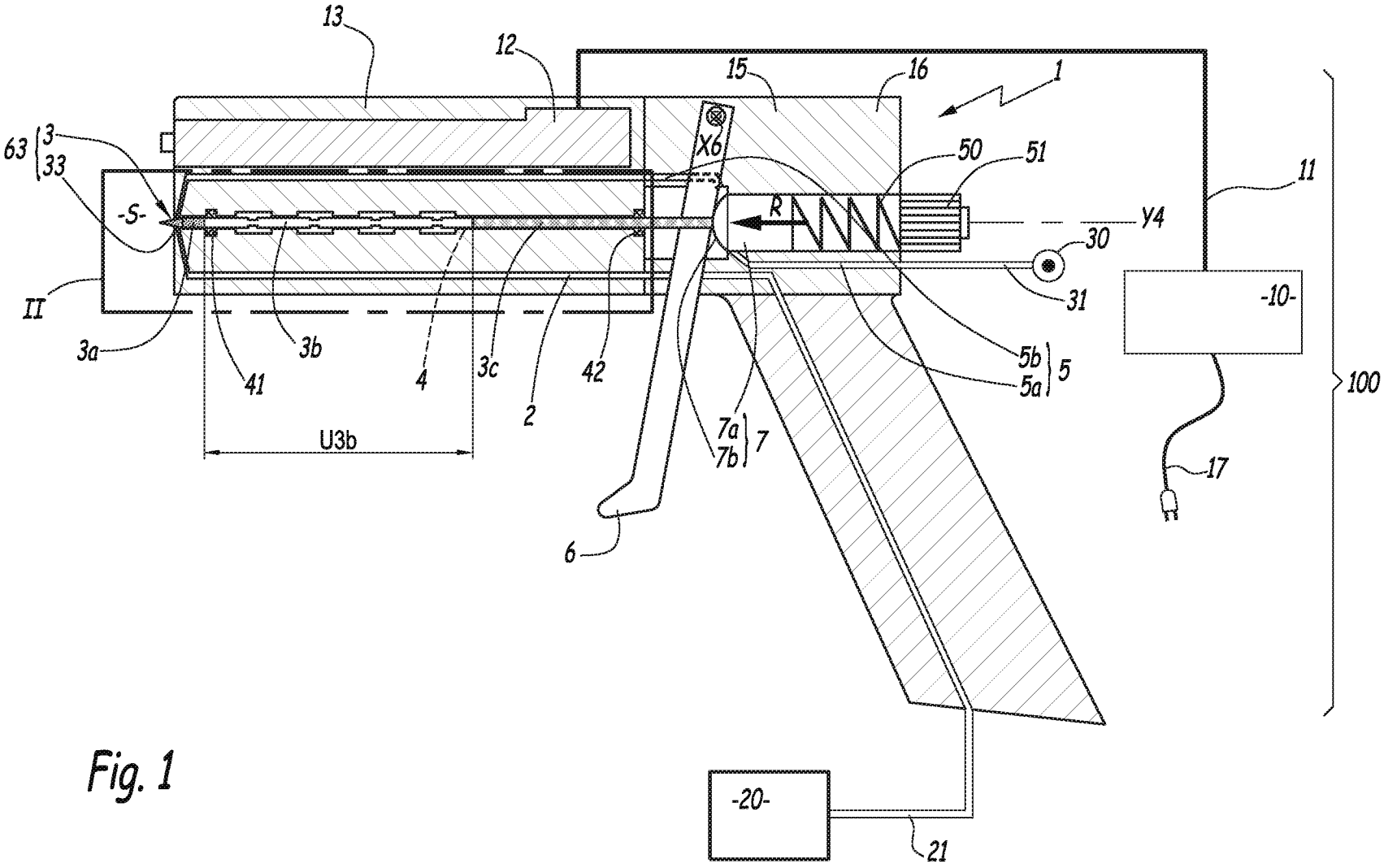

inside the recess, can increase the electric creepage distance along the central portion.

10 Claims, 4 Drawing Sheets

(51) Int. Cl.
*B05B 1/30* (2006.01)
*B05B 1/32* (2006.01)

(58) Field of Classification Search
USPC ..... 239/690, 692, 704, 583
See application file for complete search history.

(56) References Cited

U.S. PATENT DOCUMENTS

| | | | | |
|---|---|---|---|---|
| 6,460,787 | B1 | 10/2002 | Hartle et al. | |
| 8,430,058 | B2 | 4/2013 | Sakakibara et al. | |
| 2005/0229845 | A1* | 10/2005 | Mather | B05B 5/032 118/308 |
| 2006/0124782 | A1* | 6/2006 | Matsumoto | B05B 5/0533 239/706 |
| 2012/0031329 | A1 | 2/2012 | Sakakibara et al. | |

FOREIGN PATENT DOCUMENTS

| | | | |
|---|---|---|---|
| JP | 2003525743 | A | 9/2003 |
| JP | 2008246384 | A | 10/2008 |
| JP | 2008290046 | A | 12/2008 |
| JP | 2009039684 | A | 2/2009 |
| JP | 2009220034 | A | 10/2009 |
| RU | 2115487 | C1 | 7/1998 |
| WO | 200166261 | A2 | 9/2001 |

* cited by examiner

SPRAY NOZZLE FOR ELECTROSTATIC SPRAYING OF A COATING PRODUCT AND FACILITY FOR SPRAYING A COATING PRODUCT INCLUDING SUCH A SPRAY NOZZLE

This is a National Stage application of PCT international application PCT/EP2014/064554, filed on Jul. 8, 2014 which claims the priority of French Patent Application No. 12 56727 entitled "SPRAY NOZZLE FOR ELECTROSTATIC SPRAYING OF A COATING PRODUCT AND FACILITY FOR SPRAYING A COATING PRODUCT INCLUDING SUCH A SPRAY NOZZLE", filed Jul. 9, 2013, both of which are incorporated herein by reference in their entirety.

The invention relates to a spray nozzle for electrostatic spraying of a coating product, and a facility for spraying a coating product including such a spray nozzle.

A spray nozzle for electrostatically spraying a coating product makes it possible to electrostatically charge a coating product and offers a good transfer rate of the coating product onto the support to be covered. When the coating product is designed to be charged, one end of a spray needle is brought to a high voltage that may go from 10 to 200 kilovolts (kV), using a high-voltage unit comprised in the spray nozzle.

One recurring issue for a spray nozzle for electrostatic spraying of a coating product is that of limiting the length, the bulk and the general weight of the spray nozzle to improve its handling. The choice of these parameters is dictated by the fact that a trigger and a rear portion of the spray nozzle must necessarily be at the earth potential when, in order to charge the coating product, one end of the needle of the spray nozzle is brought to the high voltage.

Thus known from document WO-A2-01/66261 is a spray nozzle for electrostatic spraying that comprises a needle forming a mobile shutter of a valve for controlling the spraying of coating product and a high-voltage unit capable of bringing a front end of the needle to the high voltage. However, in the field of spraying coating product using a spray nozzle for electrostatic spraying, standard FM7260, which is the most restrictive at this time, recommends observing no electric creepage along a needle or a barrel of the spray nozzle, when a voltage equal to 1.5 times the maximum voltage that a high-voltage unit comprised in the spray nozzle can generate is applied to one end of the needle for one minute. Thus, the known spray nozzles for the electrostatic spraying a coating product, like that described in document WO-A2-01/66261, are long, and therefore difficult to handle. Furthermore, in this type of spray nozzle, the air confined between the needle and its recess in the barrel of the spray nozzle ionizes quickly, which generates ozone production, which corrodes the surrounding materials and ultimately causes piercing and electric creepage that may be dangerous.

The invention more particularly intends to resolve these drawbacks by proposing a spray nozzle for electrostatic spraying of a coating product that is easy to handle and that has improved safety.

To that end, the invention relates to a spray nozzle for electrostatic spraying of a coating product comprising a needle which forms a moving shutter of a valve for controlling the spraying of the coating product and positioned in a recess of a barrel of the spray nozzle, that recess defining a surface for guiding the axial translation of the needle along a longitudinal axis of the recess, the needle comprising a front end having a shape suitable for abutting against a seat in order to obstruct a duct for the flow of the coating product, a rear portion which interacts with means for controlling the translation of the needle, and a central portion comprised between the front end and the rear portion, the spray nozzle also comprising a high-voltage unit capable of applying a high voltage to the front end of the needle. According to the invention, at least one first raised portion is provided on the central portion of the needle, inside the recess, which is capable of increasing the electric creepage distance along the central portion.

Owing to the invention, the first machining done in the needle makes it possible to produce lighter, smaller, easier-to-handle spray nozzles with increased safety during use, since the first machining operations make it possible to increase the electric creepage distance for a same length of the barrel and the needle, and thus to improve the resistance of the spray nozzle to those creepages. These raised portions make it possible to increase the electric creepage distance. They also made it possible to produce spray nozzles smaller than what the intrinsic qualities of the materials used theoretically allow.

According to advantageous but optional aspects of the invention, such a spray nozzle for electrostatic spraying of a coating product may incorporate one or more of the following features, considered in any technically possible combination:

- several first raised portions are arranged on the central portion of the needle and form hollow portions relative to an envelope surface of the central portion of the needle;
- the first raised portion(s) form a first hollow spiral relative to the envelope surface of the central portion of the needle;
- the central portion comprises a globally cylindrical portion and the first raised portion(s) form a spiral protruding from the cylindrical portion;
- at least one second raised portion is arranged in the recess, across from the first raised portion(s);
- several second raised portions are arranged in the recess and the second raised portions form hollow portions relative to the surface for guiding the needle;
- the second raised portion(s) form a second hollow spiral relative to the surface for guiding the needle;
- the protruding spiral and the second hollow spiral are in the same direction, and the protruding spiral has a globally constant first width, measured along the longitudinal axis, and the second hollow spiral has a globally constant second width, measured along the longitudinal axis, and the first width is comprised between 10% and 50% of the second width;
- the protruding spiral and the second hollow spiral are in opposite directions;
- the first raised portion(s) form portions with a reduced diameter relative to the diameter of the envelope surface of the central portion of the needle, while the diameter of the first raised portions is comprised between 15% and 60% of the diameter of the envelope surface of the needle, and the sum of the lengths, measured parallel to the longitudinal axis, over which each first raised portion extends is comprised between 10% and 50% of the length, measured parallel to the longitudinal axis, of the central portion of the needle;
- the second raised portions form machined portions whereof the diameter is comprised between 101% and 200% of the diameter of the surface for guiding the needle, and the length, measured parallel to the longitudinal axis, over which each second raised portion extends is comprised between 120% and 200% of the length over which each first raised portion extends;

a volume left free by the first and second raised portions between the needle and its recess is filled with an electrically insulating product.

The invention also relates to a facility for spraying a coating product comprising a power source, a reservoir of coating product and at least one spray nozzle for electrostatic spraying of a coating product as mentioned above.

Figure 2:
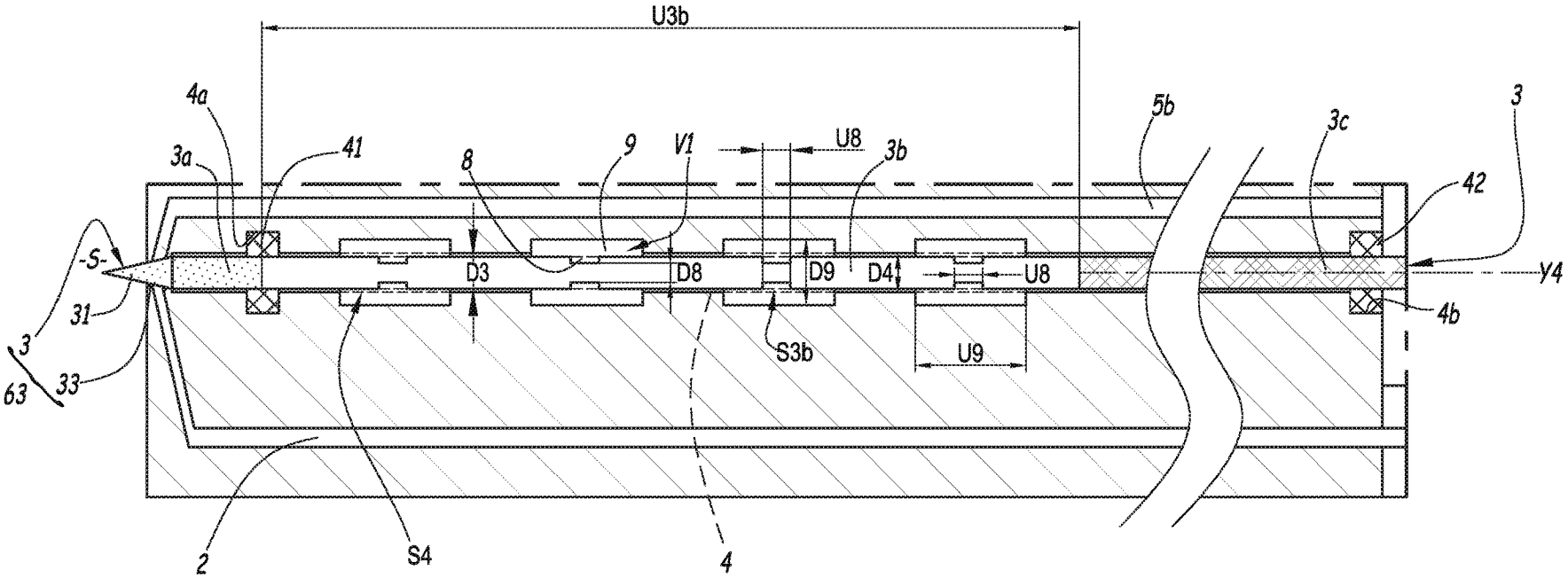
Figure 3:
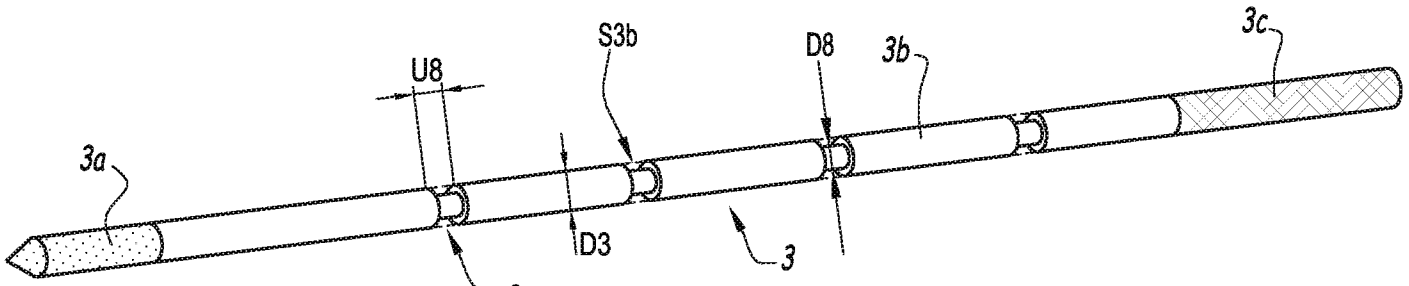
Figure 4:
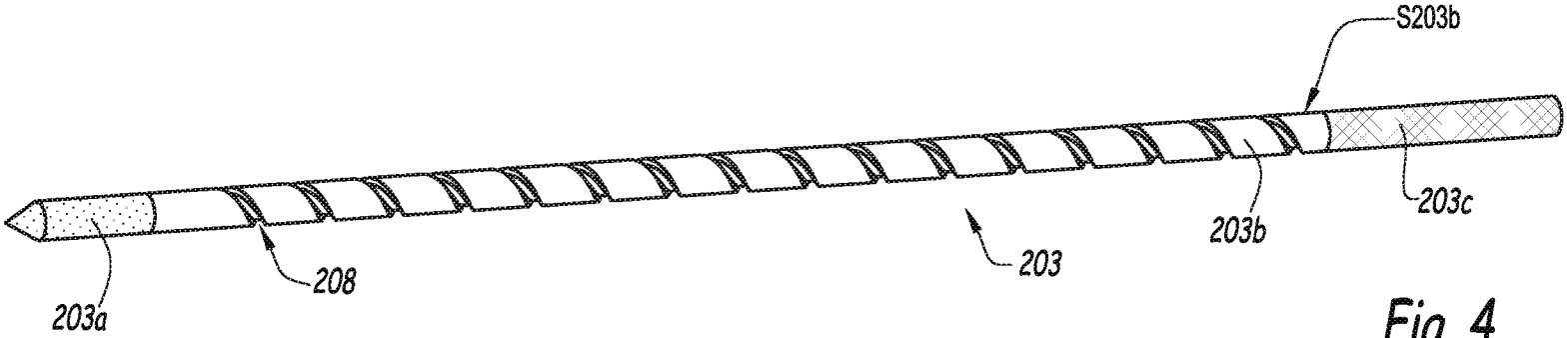
Figure 5:
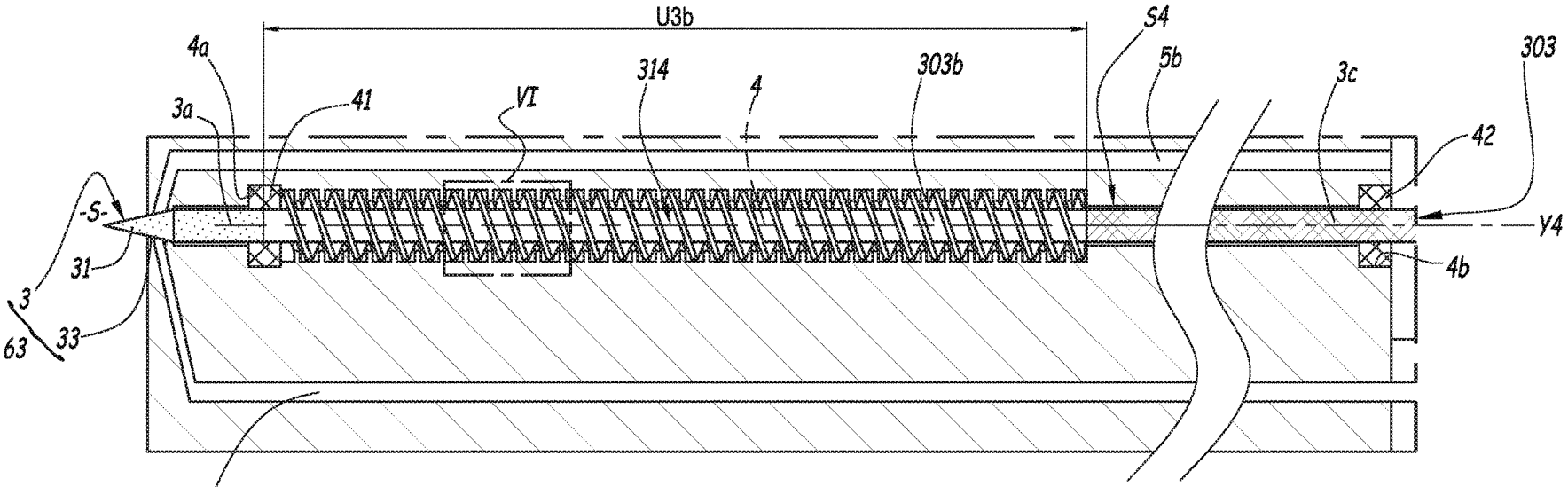
Figure 6:
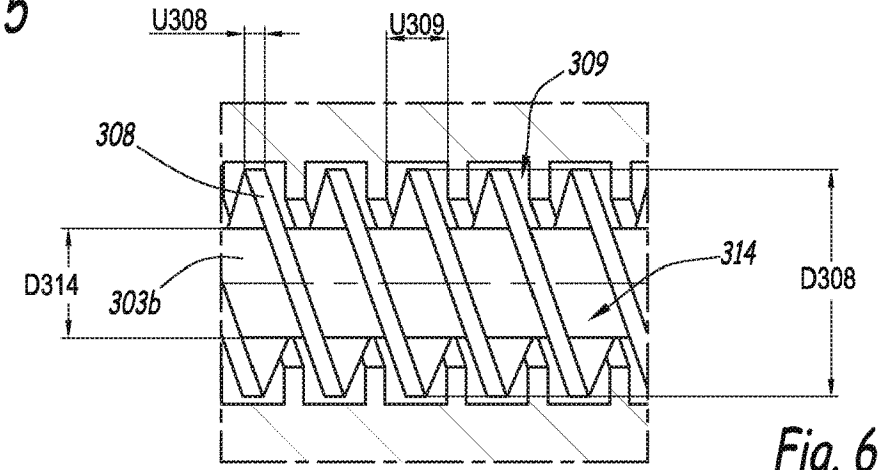

The invention will be better understood, and other advantages thereof will appear more clearly, in light of the following description of two embodiments of a spray gun for electrostatic spraying of a coating product and a facility according to its principle, provided solely as an example and done in reference to the appended drawings, in which:

FIG. 1 is a diagrammatic sectional illustration of a facility comprising a gun according to a first embodiment of the invention, FIG. 2 is a larger partial illustration of detail II of FIG. 1, FIG. 3 is a perspective illustration of the needle of the gun of FIGS. 1 and 2, FIG. 4 is a perspective illustration of the needle of a gun according to a second embodiment, FIG. 5 is a partial illustration of a barrel of a gun according to a third embodiment of the invention, FIG. 6 is an enlarged illustration of detail VI of FIG. 5.

The facility 100 shown in FIG. 1 allows the electrostatic coating of an object, not shown. This facility 100 comprises a gun 1 for electrostatic spraying of a coating product supplied with coating product from a coating product reservoir 20, by a hose 21.

The gun 1 is also connected to a pressurized air source 30 by a hose 31. The air coming from the source 30 is used to spray the coating product by driving it from the gun 1 toward the object to be coated.

Reference 2 denotes a flow duct of the coating product inside the gun 1.

Reference 4 denotes a recess situated in a barrel 13 of the gun 1 in which a needle 3 slides, when an operator presses on a trigger 6 or releases the trigger 6 of the gun 1. The recess 4 defines a surface S4 for guiding the translation of the needle 3 along a longitudinal axis Y4 of the recess 4. The surface S4 is cylindrical with a circular base.

The needle 3 has a fully cylindrical shape except at a front end 3*a*, positioned near a spray outlet S of the coating product, which forms a triangular tip. The needle 3 also comprises a rear portion 3*c* connected to the trigger 6 and the central portion 3*b* comprised between the front end 3*a* and the rear portion 3*c*. The movement of the needle 3 is controlled by the connection between the rear portion 3*c* and the trigger 6.

The needle 3 is made from three different materials in three different parts. The end 3*a* of the needle 3, designed to be brought to a high potential, is made from a first electrically conductive material with a high Shore hardness, in particular greater than or equal to 55 HRC. The end 3*a* is shown by a zone comprising dots in FIGS. 1, 2 and 3. The central portion 3*b* of the needle is made up of a second insulating material, while the rear portion 3*c* of the needle 3, corresponding to the portion of the needle 3 that is cross-hatched in FIGS. 1, 2 and 3, is made from an electrically conductive and hard material. The materials of the parts 3*a* and 3*b* may be identical or different.

The recess 4 for receiving the needle 3 comprises a first groove 4*a* situated on the side of the outlet S and the end 3*a*, at the connection between the end 3*a* and the central portion 3*b* of the needle 3. A first seal 41 is positioned in the groove 4*a*, around the needle 3 with which it is in sliding contact. This seal 41 ensures sealing of the recess 4, with respect to elements outside the gun 1 and with respect to the coating product, which, during spraying of the coating product, emerges via the duct 2 at the end 3*a* of the needle 3. Furthermore, the recess 4 comprises a second groove 4*b* situated on the side of the trigger 6 and the rear portion 3*c*, opposite the first groove 4*a*. A second seal 42 is positioned in the groove 4*b*, around the needle 3 with which it is in sliding contact. This second seal 4*b* offers good sealing of the recess 4 with respect to the intrusion of bodies or products from the outside, such as dust, solvents or paint residues. The materials of the seals 41 and 42 are adapted to the material(s) making up the end 3*a* and the rear portion 3*c* to guarantee tight bearing of the needle 3 against those seals.

Reference 5 denotes an airflow duct inside the gun 1. This duct 5 comprises a first segment 5*a* and a second segment 5*b*, between which there is a valve 7 for controlling the flow of air. The second segment 5*b* emerges near the end 3*a* of the needle 3 at the outlet S.

The air valve 7 comprises a shutter 7*a* suitable for bearing against a seat 7*b*, with a corresponding shape, under the effect of a return force R exerted by a spring 50 kept in position by a stopper 51 forming a fixed bearing point for that spring 50. The shutter 7*a* is secured in translation with the needle 3. Thus, the spring 50 makes it possible to keep the needle 3 in a position preventing the flow of the coating product from the duct 2 toward the outlet S when no force is exerted on the trigger 6 of the gun 1. More specifically, the end 3*a* of the needle 3 has a shape suitable for bearing against a seat 33 with a corresponding shape under the effect of the return force R. Thus, the needle 3 and the seat 33 together form a valve 63 for controlling the flow of the coating product. The needle 3 forms the mobile shutter of the valve 63.

The trigger 6 is articulated on a body 15 of the gun around an axis X6 perpendicular to the axis Y4. It allows the opening and closing of the valves 7, as well as the movements of the needle 3 parallel to the axis Y4. More specifically, the trigger 6 bears against the shutter 7*a* and makes it possible, when it undergoes a force opposite the return force R, to exert a force opposite the return force R on the shutter 7*a* so as to axially offset, along the axis Y4, the shutter 7*a* relative to its seat 7*b*. This makes it possible to set the needle 3 in motion parallel to the axis Y4. When the trigger 6 is released, the spring 50 pushes back the shutter 7*b* and the needle 3 toward the position interrupting the airflow duct 5 and the coating product flow duct 2, respectively. The trigger 6 thus makes it possible to control the flow of coating product and pressurized air in the flow ducts 2 and 5.

The gun 1 is also connected to a high voltage generator 10, by an electric cable 11 that makes it possible to supply a high-voltage unit 12, positioned in the barrel 13 of the gun 1, with current. The generator 10 is in turn supplied with current from the sector, using a cable 17.

The high-voltage unit 12 makes it possible to bring the end 3*a* of the needle 3, to which it is electrically connected by means that are not shown, to a high voltage, i.e., a potential whose absolute value is comprised between 10 kV and 200 kV.

On the outer contour of the central portion 3*b* of the needle 3, across from the recess 4, along the needle 3, first machinings 8 are regularly arranged. The central portion 3*b* has an envelope surface S3*b* with a cylindrical shape and circular base with diameter D3. The first machinings 8 form hollow portions, relative to the envelope surface S3*b* of the needle 3, which have a diameter D8 smaller than the diameter D3 of the envelope surface S3*b*. The diameter D8 of the hollow portions formed by the first machinings is preferably comprised between 15% and 60% of the diameter D3 of the envelope surface S3*b*.

Reference U8 denotes a length, measured parallel to the axis Y4, over which each first machining 8 extends.

Likewise, in the recess 4, second machinings 9 are arranged across from the first machinings 8. The second machinings 9 form hollow portions relative to the surface S4 for guiding the needle 3. The diameter D9 of the hollow portions formed by the second machinings 9 is larger than the diameter D4 of the surface S4 for receiving and guiding the needle 3. The diameter D9 of the hollow portions is preferably comprised between 101% and 200% of the diameter D4 of the surface S4.

Reference U9 denotes a length, measured parallel to the axis Y4, over which each second machining 9 extends.

Each first machining 8 extends parallel to the axis Y4 over the length U8. The sum of the lengths U8 over which each first machining 8 extends is comprised between 10% and 50% of the length U3*b* of the central portion 3*b* of the needle 3, measured parallel to the axis Y4.

Each second machining 9 extends over a length U9 greater than the length U8. Preferably, the length U9 is comprised between 120% and 200% of the length U8. The first machinings 8 and the second machinings 9 make it possible to increase the electric creepage distance, relative to a configuration where the needle and the recess do not comprise a machining, and thus to prevent the trigger 6 or a rear portion 16 of the gun 1 from being at a potential different from the earth potential when the end 3*a* of the needle 3 is brought to the high voltage.

Furthermore, since the second machinings 9 are arranged over a length U9 greater than the length U8 over which the first machinings 8 are arranged, irrespective of the position of the needle 3 in the recess 4, the electric creepage distance does not change.

Furthermore, a volume V1 left free between the needle 3 and its recess 4 is filled with an electrically insulating product. This product may for example be dielectric oil. Through its properties, it makes it possible to increase the length of the creepage path between the front end 3*a* and the rear portion 3*c*, and thus to produce a shorter barrel 13 than would be allowed by the intrinsic qualities of the materials used for the barrel 13 and the needle 3. Furthermore, this electrically insulating product avoids any ozone formation. Indeed, in the absence of this insulating product, the air confined between the needle 3 and its recess 4 in the barrel 13 ionizes quickly, which generates ozone. Yet ozone is a harmful gas for health and corrodes the component materials of the needle 3 and its recess 4, which ultimately causes electric creepages that may reach the operator's hand in the case of a manual gun 1.

In the second embodiment of the gun shown in FIG. 4, a needle 203 is globally similar to the needle 3 of the first embodiment, but comprises different first machinings 208.

In the second embodiment, the elements similar to those of the first embodiment bear the same numerical references, increased by 200.

In the following, we describe what distinguishes the second embodiment from the first embodiment.

Thus, the first machinings 208 form spiral hollow portions, relative to the envelope surface S203*b* of the central portion 203*b* of the needle 203, around the central portion 203*b*. The first machinings therefore form a first hollow spiral relative to the envelope surface S203*b* of the central portion 203*b* of the needle 203. Likewise, second machinings arranged in the corresponding recess of the barrel, not shown, forming a second hollow spiral across from those first machinings 208, relative to the surface for guiding the needle 203.

In the third embodiment of the gun shown in FIGS. 5 and 6, a needle 303 is globally similar to the needle 203 of the second embodiment, but comprises first raised portions 308 different from the first machinings 208. In the third embodiment, the elements similar to those of the first embodiment bear the same numerical references. In the following, we describe what distinguishes the third embodiment from the first embodiment.

The first raised portions 308 form a spiral positioned around the central portion 303*b* of the needle 303. More specifically, the central portion 303*b* comprises a globally cylindrical portion 314 and the first raised portions 308 protrude from the cylindrical portion 314. Reference D314 denotes the diameter of the cylindrical portion 314, and reference D308 denotes the diameter of the first raised portion 308.

The diameter D308 of the spiral formed by the first raised portion 308 is larger than the diameter D314 of the cylindrical portion 314. Preferably, the diameter D308 is comprised between 15% and 60% of the diameter D314.

Furthermore, similarly to what was described for the second embodiment, the recess of the barrel 13 comprises second machinings 309 that form a second hollow spiral across from the first raised portions 308, relative to a surface S4 for guiding the needle 303.

Reference U308 denotes a first width, measured along the longitudinal axis Y4 of the protruding spiral 308. The first width U308 is globally constant around the central portion 303*b*.

Likewise, reference U309 denotes a second width, measured along the longitudinal axis Y4, of the second hollow spiral 309. The second width U309 is globally constant along the recess 4.

The protruding spiral 308 and the second hollow spiral 309 have complementary shapes, such that the protruding spiral 308 is able to be screwed in the second hollow spiral 309. Furthermore, the protruding spiral 308 and the second hollow spiral 309 are in the same direction.

The first width U308 is comprised between 10% and 50% of the second width U309. More specifically, the second width U309 is greater than the first width U308, such that the second width U309 is greater than the sum of the first width U308 and a longitudinal translational travel of the needle 303. The longitudinal translational travel of the needle 303 corresponds to the distance traveled by the needle 303 along the longitudinal axis Y4, between the position of the needle 303 when the trigger 6 of the gun 1 is released and the position of the needle 303 when the trigger 6 is completely activated.

Alternatively, the first and second machinings form hollow portions with any shapes.

According to another alternative, in the second embodiment, the needle 203 comprises a single machining forming the first hollow spiral.

According to another alternative, in the third embodiment, the needle 303 comprises a single first raised portion forming a protruding spiral.

According to another alternative, the machinings are not arranged regularly along the central portion 3*b* of the needle 3 and the recess 4.

According to another alternative, the generator 10 is supplied with current from an autonomous source.

According to another alternative, in the second and third embodiments, the recess 4 comprises a single second machining forming the second hollow spiral.

According to another alternative, the protruding spiral 308 and the second hollow spiral 309 of the third embodiment are in opposite directions.

According to another alternative, the needle and its recess have complementary shapes, but not cylindrical shapes.

According to still another alternative, the hollow portions are formed by protruding elements of the needle 3 and the recesses 4. In that case, those elements either form a single piece with the needle 3 or the recess 4, or form parts attached on the needle 3 or the recess 4.

In FIG. 1, the illustrated gun 1 is a manual spray nozzle for electrostatic spraying of a coating product. Alternatively, this gun is an automatic spray nozzle for spraying coating product.

The technical features of the embodiment and alternatives considered above may be combined with one another to create other embodiments.

The invention claimed is:

1. A spray nozzle for electrostatically spraying a coating product comprising:

a needle forming a moving shutter of a valve for controlling the spraying of the coating product and positioned in a recess of a barrel of the spray nozzle, the recess defining a guiding surface for guiding the axial translation of the needle along a longitudinal axis of the recess, the needle comprising a front end having a shape suitable for abutting against a seat in order to obstruct a duct for the flow of the coating product, a rear portion which interacts with means for controlling the translation of the needle, and a central portion comprised between the front end and the rear portion, a high-voltage unit capable of applying a high voltage to the front end of the needle, wherein at least one first raised portion is provided on the central portion of the needle, inside the recess, the at least one first raised portion being capable of increasing the electric creepage distance between the front end and the rear portion along the central portion relative to a configuration where no at least one first raised portion were present, wherein the central portion is electrically insulating, and wherein at least one second raised portion is arranged in the recess and faces the at last one first raised portion and the at least one second raised portion and the at least one first raised portion both intersect a plane that extends perpendicular to the longitudinal axis of the recess.

2. The spray nozzle according to claim 1, wherein the at least one first raised portion forms a first hollow spiral relative to the envelope surface of the central of the needle.

3. The spray nozzle according to claim 1, wherein the central portion comprises a globally cylindrical portion and the at least one first raised portion forms a protruding spiral protruding from the cylindrical portion.

4. The spray nozzle according to claim 1, wherein several second raised portions are arranged in the recess, and wherein the several second raised portions form hollow portions relative to the guiding surface for guiding the needle.

5. The spray nozzle according to claim 1, wherein the at least one second raised portion forms a second hollow spiral relative to the guiding surface for guiding the needle.

6. The spray nozzle according to claim 5, wherein the central portion comprises a globally cylindrical portion and the at least one first raised portion forms a protruding spiral protruding from the cylindrical portion, wherein the protruding spiral and the second hollow spiral are in the same direction, wherein the protruding spiral has a globally constant first width, measured along the longitudinal axis, wherein the second hollow spiral has a globally constant second width, measured along the longitudinal axis, and wherein the first width is comprised between 10% and 50% of the second width.

7. The spray nozzle according to claim 5, wherein the central portion comprises a globally cylindrical portion and the at least one first raised portion forms a protruding spiral protruding from the cylindrical portion and wherein the protruding spiral and the second hollow spiral are in opposite directions.

8. The spray nozzle according to claim 1, wherein a volume left free by the at least one first raised portion between the needle and its recess is filled with an electrically insulating product.

9. A facility for spraying a coating product comprising a power source, a reservoir of coating product and at least one spray nozzle for electrostatic spraying of a coating product, wherein the spray nozzle is according to claim 1.

10. The spray nozzle according to claim 1, wherein several second raised portions are arranged in the recess, and wherein the several second raised portions form hollow portions relative to the guiding surface for guiding the needle.

* * * * *